United States Patent [19]

Cope

[11] 4,274,339

[45] Jun. 23, 1981

[54] RADIALLY STEERING RAILWAY TRUCK ASSEMBLY

[75] Inventor: Geoffrey W. Cope, Williamsville, N.Y.

[73] Assignee: Dresser Industries, Inc., Dallas, Tex.

[21] Appl. No.: 43,199

[22] Filed: May 29, 1979

[51] Int. Cl.[3] ..... B61F 3/08; B61F 5/38; B61F 5/52

[52] U.S. Cl. ..... 105/168; 105/182 R; 105/224.1

[58] Field of Search ..... 105/165, 167, 168, 182 R, 105/199 R, 224.1

[56] References Cited

U.S. PATENT DOCUMENTS

| | | | |
|---|---|---|---|
| 922,750 | 5/1909 | Clark | 105/167 X |
| 995,470 | 6/1911 | Knobbs | 105/165 |
| 3,054,361 | 9/1962 | Erzer et al. | 105/168 |
| 3,789,770 | 2/1974 | List | 105/168 |
| 4,067,261 | 1/1978 | Scheffel | 105/182 R X |
| 4,067,262 | 1/1978 | Scheffel | 105/224.1 X |
| 4,131,069 | 12/1978 | List | 105/182 R X |

OTHER PUBLICATIONS

Armstrong, John H., Freight Car Trucks, Railway Age, Dec. 11, 1978, pp. 14–19.

The Dresser DR-1 Advertisement Pamphlet, 1978, pp. 1–8.

*Primary Examiner*—John P. Silverstrim
*Assistant Examiner*—Howard Beltran
*Attorney, Agent, or Firm*—J. N. Hazelwood; B. E. Deutsch

[57] ABSTRACT

A steering assembly for a radially steerable articulated railway car truck has a pair of steering arms that are operably joined to the truck axles and connected together by a linkage passing over the truck bolster adjacent the side frames. The steering arms can be retrofitted to an existing conventional (non-radially steerable) three piece railway truck regardless of the type of brake rigging the truck employs. The linkage structure includes a pivotable link located at each end of the bolster and joining the steering arms for articulated movement.

15 Claims, 12 Drawing Figures

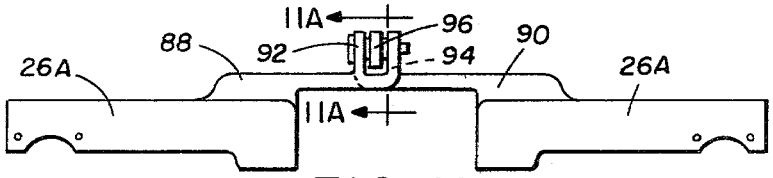
FIG. 11
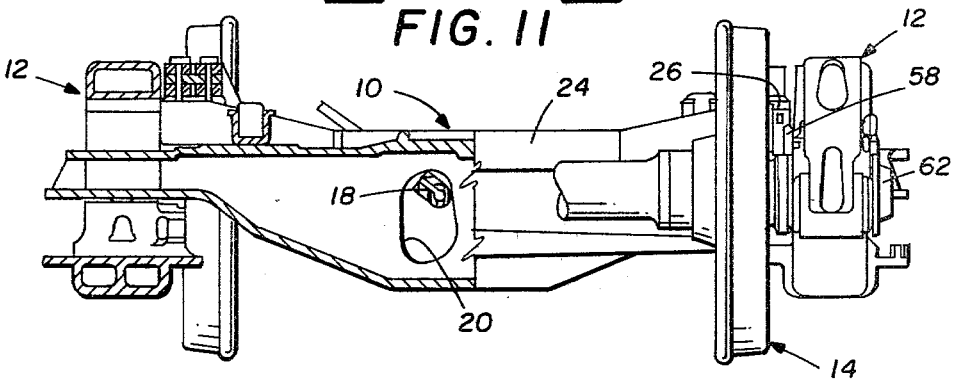
FIG. 3
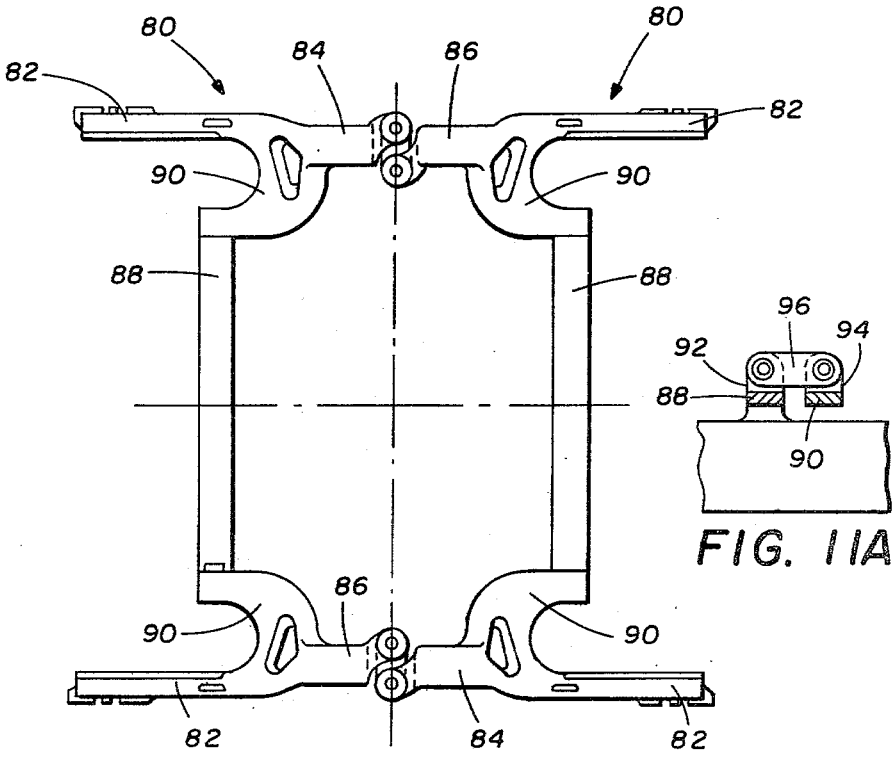
FIG. 11A
FIG. 10

RADIALLY STEERING RAILWAY TRUCK ASSEMBLY

TECHNICAL FIELD

This invention is related to steering arm constructions for radially steerable railway car trucks of the type which does not have a connection between the steering assembly and the vehicle body.

BACKGROUND OF THE INVENTION

The use of interconnected steering arms to control the position of wheel sets in a radially steerable railway car truck is a well established technique. Basically, this technique utilizes the nature of the conical wheel tread along with the shape of the rail in order to develop a radial steering function as the truck moves through curves and also to provide lateral stability when moving on straight track.

Because several types of brake rigging or brake actuating apparatus are presently and have in the past been utilized in the railroad industry, this can present considerable difficulty when retrofitting an existing truck with a radial steering arm assembly. Some of the brake riggings have elements of their mechanism disposed through the truck bolster and likewise some of the prior steering arm assemblies also utilize elements which pass through openings in the truck bolster. Because of these configurations, mechanical interferences between the brake rigging and the steering arms can significantly limit the application of steering arm designs which pass through the truck bolster.

One additional complication of steering arm assemblies which pass through the bolster is due to the existing passageway through the bolster being located in an off-center position relative to the center line of the truck. Because of this bolster configuration, the steering arms are not identical and must be constructed in pairs. These pairs of steering arms must be correctly matched to assure that the truck axles will position the wheels in a square configuration when the truck is assembled.

SUMMARY OF THE INVENTION

In an embodiment, the steering arm structure includes a pair of identical arms which are generally U-shaped with end portions thereof operably connectable to a wheel set and the opposite side portions thereof at the closed end portion connected to the like portion of the other steering arm by a pivotable linkage passing over the bolster.

One object of this invention is to provide a steering assembly for a conventionally styled three piece railway car truck which can be fitted to the truck regardless of the type of brake rigging utilized.

Another object of this invention is to provide a steering assembly for a radially steerable truck which requires a minimum of effort to install and will require a minimum change in normal maintenance procedures as compared with that of a standard truck which does not utilize radial steering.

Still another object of this invention is to provide a steering assembly which has a pair of identical individual arms that can be interchanged and easily arranged into a square configuration on a truck to place the wheel sets in a parallel relationship.

Another object of this invention is to provide a steering assembly for a radially steerable truck which has two identical steering arms connected in a manner which will provide a positive lateral connection to eliminate relative lateral movement between the wheel sets and at the same time provide for relative radial positioning of the wheel sets for curved track negotiation and limited longitudinal movement in order to prevent the steering arms from sustaining braking or end impact forces during operation.

Another object of this invention is to provide a steering assembly for a radially steerable railway truck which has a steering arm connected to each wheel set and the steering arms joined by laterally oriented links with spherically pivotable connections to allow for relative vertical misalignment of the arms during connections when the truck is negotiating track with cross level variations or a vertical deviation and to prevent distortion of the steering arms in the event of a partial or complete derailment.

Various other objects, advantages and features of this invention will become apparent to those skilled in the art from the following discussion, taken in conjunction with the accompanying drawings, in which:

DESCRIPTION OF THE DRAWINGS

FIG. 3 is an end elevation view of the truck of FIG. 1 with the left side portion of the figure cutaway to the center portion of the bolster;

FIG. 10 is a plan view of a modified embodiment of the steering arms of this invention including an offset in the steering arm transverse portion for sliding sill type car constructions wherein such provides clearances for center castings;

FIG. 11 is a side elevation view of another embodiment of the steering arms and the connecting linkage; and FIG. 11A is a sectional view of the linkage taken on line 11A—11A in FIG. 11.

Figure 1:
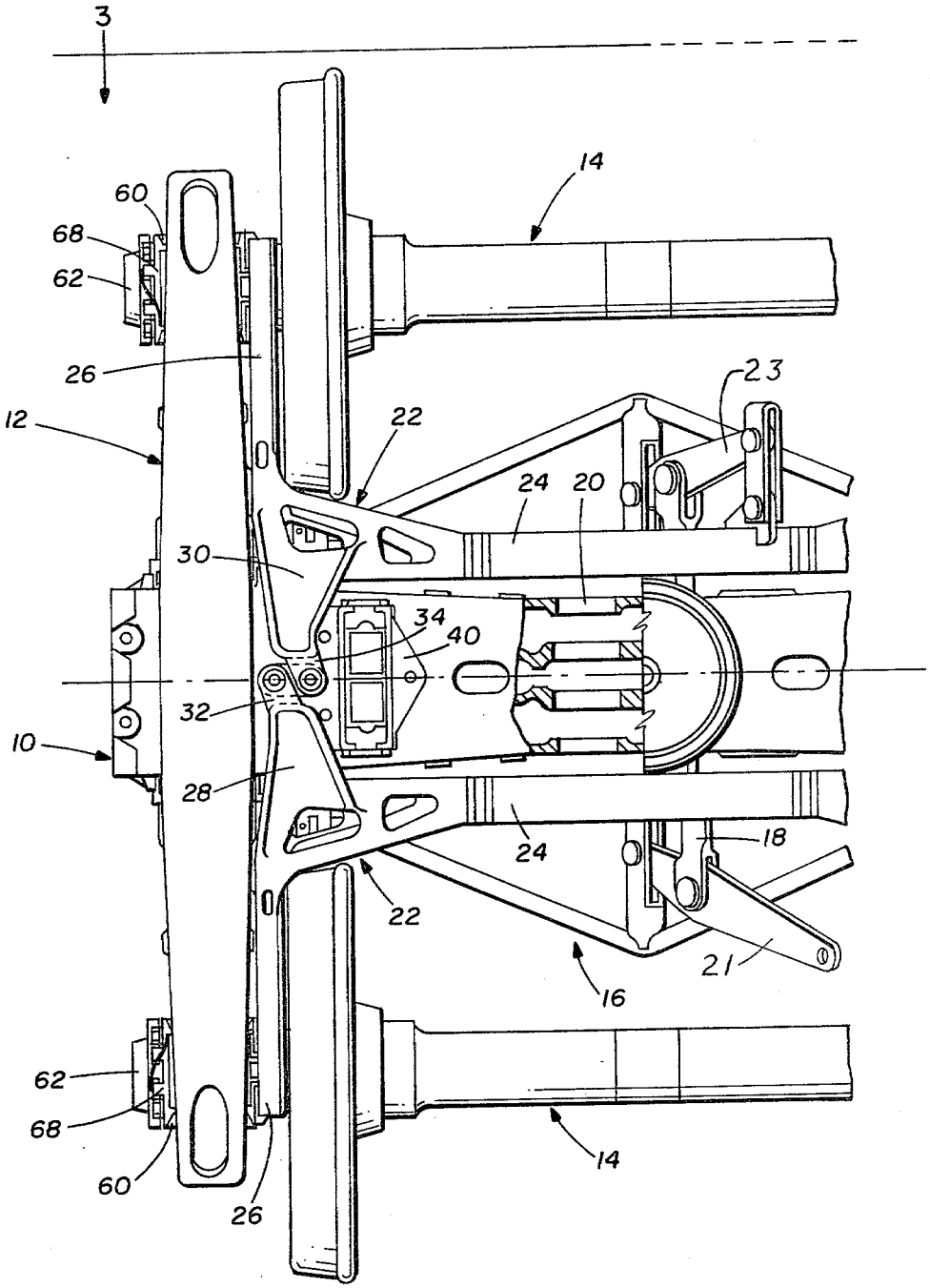
FIG. 1 is a partial plan view of a conventional railway car truck equipped with the steering assembly of this invention and with a portion of the bolster cutaway for clarity.
Figure 2:
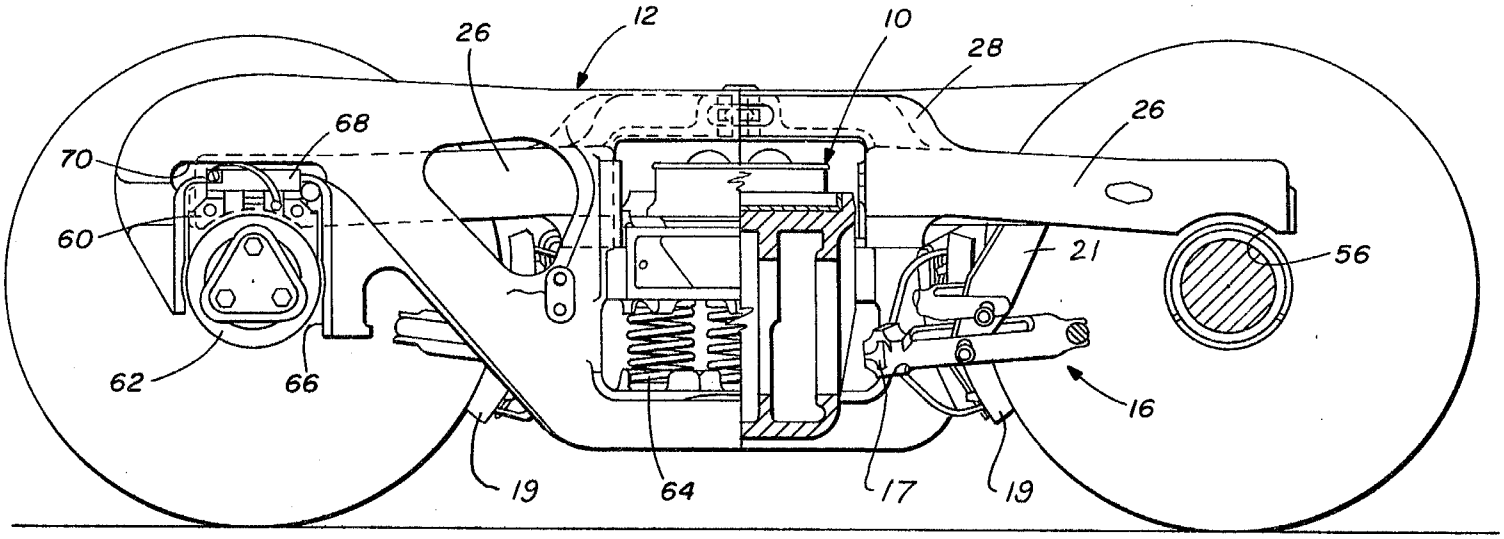
FIG. 2 is a side elevation view of the truck shown in FIG. 1 with the right hand portion of the figure showing the truck cutaway immediately behind the side frame.

The following is a discussion and description of the preferred specific embodiments of the steering arm assembly of this invention, such being made with reference to the drawings, whereupon the same reference numerals are used to indicate the same or similar parts and/or structure. It is to be understood that such discussion and description is not to unduly limit the scope of the invention.

DETAILED DESCRIPTION

The steering assembly of this invention is designed for use with a three piece two axle railroad car truck which is comprised of a bolster 10 with side frames 12 mounted transversely at each end thereof and the side frames supported on standard wheel sets 14. The truck also has a brake rigging, indicated generally at 16, which includes a pair of brake beams 17 which are supported in guides on the side frame and carry the brake shoes 19 adjacent to the wheel treads on each side of the bolster. Also included are brake beam actuating levers 21 and 23 and connecting rod 18 which extends through one of the openings 20 in the bolster. Various forms of brake rigging can be used with a standard three piece truck and they all include some portion of the apparatus extending through at least one opening in the bolster or under the bottom wall of the bolster.

The steering assembly of this invention includes a pair of substantially identically formed steering arms, indicated generally at 22, that are positioned on opposite sides of bolster 10 and have portions thereof operably connected to each wheel set. Two connector posts on each steering arm are operably connected by a pivotal linkage extending over bolster 10 to a mating connector post on the opposite steering arm. Functionally, the steering arms of this invention operate in the same basic manner as the prior art constructions. In this operation, the wheel sets are allowed limited longitudinal and lateral movement relative to the bolster. In the normal operation position on straight (tangent) track, the axles of wheel sets 14 are parallel. The conical shape of the wheel treads in combination with the shape of the rails generates forces that displace the wheel sets from the parallel relationship. The steering arms 22 transmit the forces between the wheel sets thereby coordinating their motion which has the result of stabilizing the truck as it moves on straight track and also radially positioning the wheel sets when negotiating a curve.

Figure 4:
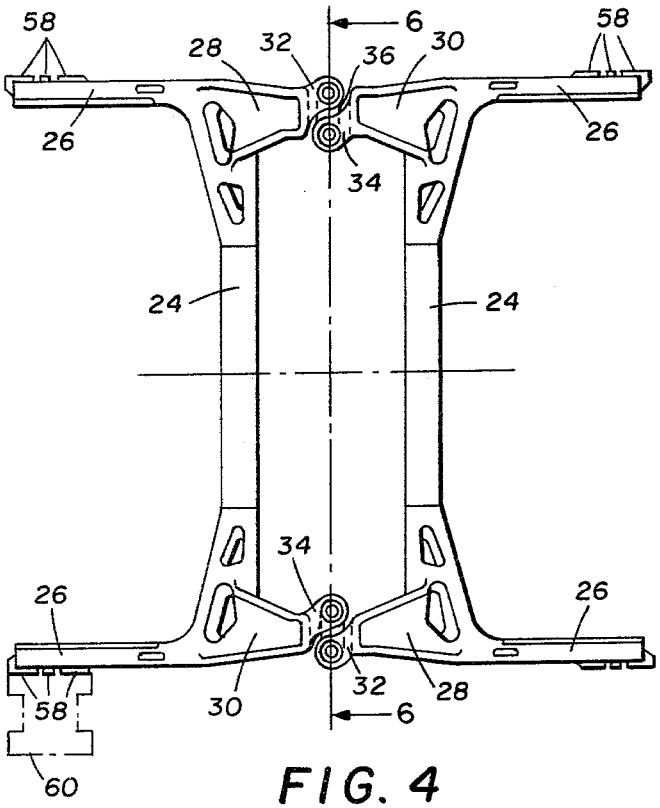
FIG. 4 is a plan view of the steering arms and their connecting linkage with the end of one arm shown having a bearing adapter (in phantom lines) therewith.
Figure 6:
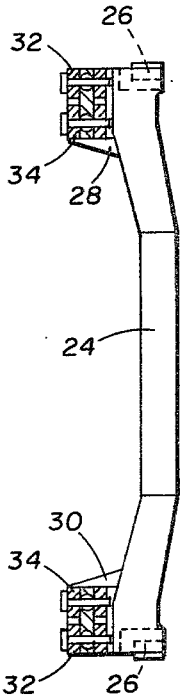
FIG. 6 is a sectional view of the steering arms taken on line 6—6 of FIG. 4.
Figure 5:
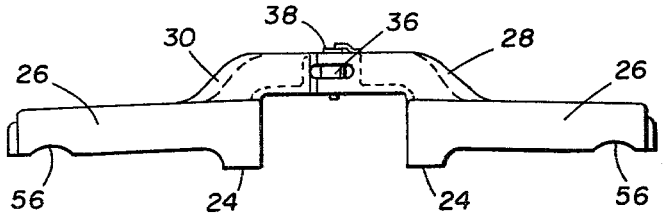
FIG. 5 is a side elevation view of the steering arms and their connecting linkage taken from a position which corresponds to that of FIG. 2.
Figure 7:
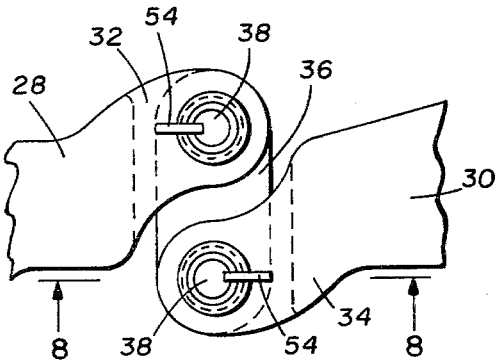
FIG. 7 is an enlarged plan view of the linkage supporting or clevis end portions of the steering arms and the connecting link.

The steering arms of this invention are generally U-shaped rigid members comprised of a transverse portion 24 which extends laterally across the truck and joins a longitudinally extending extremity 26 at each end thereof. At the corner portions of the steering arms, as formed by the junction of the transverse portion 24 and extremity 26, a connector post (28 or 30) is provided at each side of the steering arm. Connector posts 28 and 30 extend upwardly from their respective extremities 26 and in the opposite direction thereto as shown in FIG. 5. On the upper portion of each connector post is a clevis end for mounting a connecting link. Clevis end 32 on connector post 28 extends outwardly relative to the center line of the truck while the clevis end 34 on connector post 30 at the opposite side of the steering arm extends inwardly toward the center line of the truck. This offset arrangement of the clevis ends allows the steering arms to be connected in a mating fashion as shown in FIGS. 4 and 7 with the clevis ends 32 and 34 on each end of the steering arms joined by identical links 36 that are held in place by identical pins 38. Because of the interlocking and mating arrangement of the connector post and clevis ends of the steering arms, it is only necessary to produce a single steering arm configuration and use it on both sides of the truck. This configuration is greatly advantageous when large number of parts are involved because it avoids any necessity for matching sets of parts because of the hermaphroditic nature of the connecting post structure.

Figure 8:
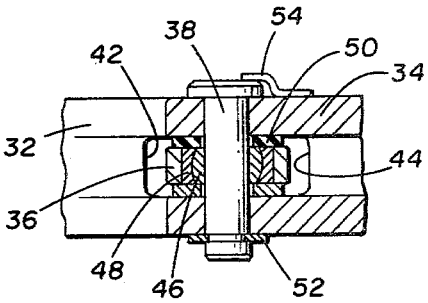
FIG. 8 is a sectional elevational view of the steering arm portions shown in FIG. 7 with the view taken on line 8—8 of FIG. 7.

The configuration of clevis ends 32 and 34 is shown in detail in FIGS. 4, 7 and 8. These clevis ends 32 and 34 are offset a similar distance either side of a longitudinally disposed line spaced a predeterminable distance from the longitudinal center line of the truck. The steering arms are made so that both sides of them are in the same relation to each other. The distance of the offset in the clevis ends is largely dependent upon the physical surroundings above the bolster and below the specific rail car body. Generally, the clevis ends and the associated link 36 are placed mid way between truck side frame 12 and side bearing assembly 40.

Connector posts 28 and 30 are appropriately shaped to permit clearance between the steering arms and truck side frames 12, bolster 10 and side bearing 40 such that the steering arms will not contact these pieces when the truck is positioned at its maximum radial position on a curved track. The connector posts also extend upwardly a sufficient distance to clear bolster 10 yet not so far as to contact the body of a rail car when the bolster springs are compressed to their maximum "solid contact." This condition would correspond to the minimum amount of clearance between the top of the steering arms and the bottom of the rail car. Also, the connector posts and corresponding clevis ends are arranged so they will not interfere with a side bearing assembly 40 that is mounted on top bolster 10 as shown in FIG. 1. Additionally, the steering arm transverse or back portion 24 is positioned sufficiently spaced from the openings through bolster 10 to permit the steering arms to be used with a bolster equipped with virtually any of the commonly utilized brake riggings.

FIGS. 5—8 show in detail construction of the connector posts upper end portions and clevis ends 32 and 34. Both of the clevis ends are constructed similarly with upper and lower portions spaced apart to receive the end portion of link 36. Each end of link 36 is provided with a spherical bearing that is connected into a clevis end, thereby allowing relative vertical motion between the steering arms while maintaining their lateral position. Referring to FIG. 8, one end portion of link 36 is positioned in opening 42 of clevis end 32 and the other end portion is positioned in opening 44 of clevis end 34. The spherical bearing assembly includes a spherical bearing member 46 which is supported in a sleeve 48 made of a low friction material that is in turn mounted through an aperture in the end portion of link 36. Annular resilient members 50 are positioned above and below link 36 and between the upper and lower sides of the clevis to centralize the position of the link between the clevises. Pin 38 is secured in position through the clevises by a lock ring 52 on the end of the pin that is opposite to the enlarged head thereof. Additionally, a lock member 54 is welded to the upper side of the associated clevis end and extends over a segment of the pin head in order to provide an additional pin retaining structure for safety.

Reference is made in this description to a particular style of spherical bearing shown in FIG. 8, however, this is not intended to limit the construction to that specific style of bearing. It is to be understood that a suitable equivalent bearing assembly which provides for substantially omnidirectional pivoting can be substituted for the shown bearing assembly. In using another omnidirectional bearing assembly, the physical construction of it would have to be sufficient to withstand prolonged use in the sometimes hostile railroad car environment.

Each of the steering arms has the extremity portion 26 thereof constructed in a similar fashion with a recess 56 in the bottom side of outer end portion thereof. On the outer portion of extremities 26, a plurality of lugs 58 are provided for cooperatively engaging with the inner side portion of a bearing adapter. One such bearing adapter 60 is shown in phantom lines in FIG. 4 positioned adjacent to lugs 58. Recesses 56 are provided so the lower portion of the steering arms will conform with the appropriate portion of bearing 62 and the cylindrical shape of the wheel set axle.

Bearing adapters 60 are shaped to interfit with lugs 58 on steering arm extremities 26. Bearing adapters 60 can be made as separate pieces and attached to steering arm extremities 26 by bolts or they can be secured by welding. In practice, bearing adapters 60 have been secured by passing bolts through apertures in the bearing adapters and threadedly engaging them in the steering arms. It is to be understood that this construction can also be accomplished by forming the bearing adapters as an integral part of the steering arms.

The assembly of a truck utilizing the steering assembly of this invention is only slightly different than that required for a conventional non-steering type truck. In this assembly the bolster and side frame are connected and the springs and brake rigging 16 are installed in the usual manner. Next, each of the steering arms is then applied to the truck by positioning the bearing adapters 60 within the openings of the associated pedestal jaws 66. Once this has been done, the steering arms are temporarily positioned with the connector posts 28 and 30 of each steering arm resting on top of bolster 10. With the steering arms in this temporary position, the wheel sets can be installed in the normal fashion by lowering the side frame and bolster assembly onto the wheel sets. Before bearing adapters 60 are positioned onto bearings 62, a resilient adapter pad 68 is positioned between the bearing adapter and the pedestal jaw roof 70. Also, before completely lowering side frames 12 to their final operating position, links 36 are connected and secured between clevis ends 32 and 34 on each side of the steering arms. Once this has been done, side frames 12 are lowered to their final resting position. Each adapter pad 68 functions as a resilient connection between the associated bearing adapter 60 and pedestal jaw roof 70 in order to allow longitudinal movement of the axles within the pedestal jaws which is needed for turning.

Once the truck has been assembled and put into use, then forces created between the wheels and the rails and other forces involved in the radial steering of this type of truck will cause the wheel sets to be properly controlled by the steering arms of this invention between a square truck position with the wheel axles parallel and an unsquare position with the wheel sets axles in a radial orientation. The pivotal connections between steering arms 22 will cause the wheel set axles to be angularly displaced in a uniform relation to each other which is needed for radial steering function of the truck.

Figure 9:
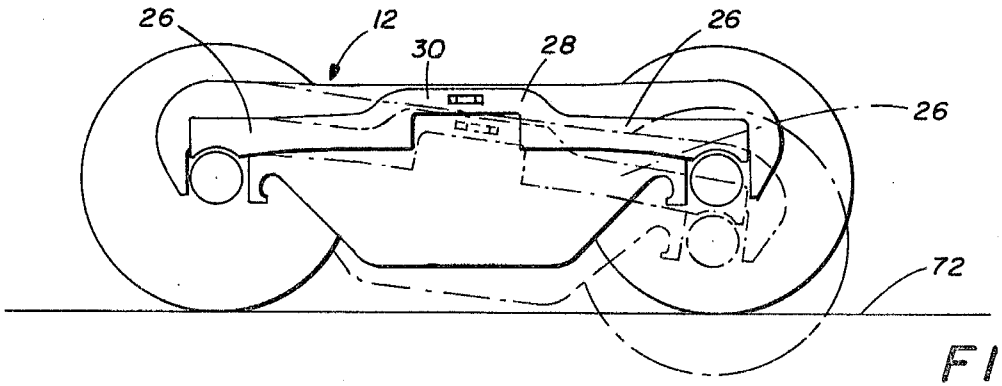
FIG. 9 is a simplified side elevation view of a rail car truck side frame, wheel sets and the steering arms of this invention illustrating the normal operating position of the track on a rail (in solid lines) and in a one wheel derailment condition (in phantom lines)

FIG. 9 shows a simplified view of the truck equipped with the steering arms of this invention. In the solid lines of this figure, the truck wheels rest on the track that is indicated by line 72. In the phantom lines of this figure, one wheel of the truck is in a derailed position. In this derailed condition, the steering arms follow the axle even into the one wheel derailment condition where there is a significant displacement between the contact surface of the derailed wheel and the other wheels of the truck. During this condition, steering arm connector posts 28 and 30 position the clevis ends in a spaced relation over the bolster with sufficient clearance between these portions of the steering arms and the top of the bolster so that the steering arms are not warped or otherwise deformed by the derailment. The pivotal nature of the linkage connection between the steering arm clevis ends provides for substantial flexure in the vertical direction of one steering arm relative to the other so the steering arms can assume the warped condition without permanent distortions.

FIG. 10 shows a modified version of the steering arms of this invention with these modified steering arms indicated generally at 80. These steering arms 80 are constructed with their extremities 82 and connector posts 84 and 86 similar to the corresponding elements described above. The steering arm transverse arm portion of back 88 has an essentially straight mid-portion which is connected by generally U-shaped segments 90 at the opposite ends thereof to extremities 82 and the connector posts 84 and 86. This construction of the steering arm transverse portion or back is done to offset the mid-portion of the steering arm from the bolster in order to accommodate center castings of cars with sliding sill cushion under frames. Because of the sliding sill cushion frame car constructions, it is necessary to provide the steering arms with the configurations shown in FIG. 10 to avoid interference with other components of the car.

FIGS. 11 and 11A show an alternate or modified embodiment of the connector post portion of the steering arms of this invention. In this embodiment, the extremities 26A and back or transverse portion are the same as that described above in conjunction with FIGS. 4 and 5 and the connector post portion of the structure is different. These connector posts 88 and 90 are formed such that clevis end portions, 92 and 94 respectively, have the openings thereof opening upward to receive and mount a linkage. For the side of the steering arms shown in FIG. 11, connector post 88 has its end portion 92 located in a spaced relation outward of the corresponding end portion 94 of the other connector post 90. The linkage connecting the connector post end portions include a link 96 supported in a spherical bearing mounts at the connector posts. Link 96 is positioned with its longitudinal axis in a horizontally disposed position and the ends thereof secured in the spherical bearings at connector post clevis end portions 92 and 94 so the steering arms can pivot relative to each other. Pivoting action of this linkage arrangement is the same functionally as that described above with respect to FIGS. 1–9. The connector posts are arranged with one terminating in a spaced relation to each other on each of the pair of steering arms to allow for interchangeability the same as the other steering arms shown in FIGS. 4–8 and 10.

From the above description, it is apparent that this steering assembly provides an improved steering assembly for retrofit applications to existing conventional three piece trucks. It will also be apparent that these steering arm constructions will not provide mechanical conflicts or encroach upon the under car space normally used for brake rigging or other car body components while providing the desirable features of radial steering. This steering assembly can be installed on conventional three piece four wheel trucks by a rather simple operation which is an important advantage when considering the assembly of large numbers of trucks and the maintenance of these trucks over a long period of time.

The embodiments of the invention in which an exclusive property or privilege is claimed are defined as follows:

1. An improved steering arm assembly for a radially steerable railway car truck having a transversely extending bolster, a side frame mounted at each end portion of the bolster, and a wheel set mounted transversely between oposed ends of the side frames with bearing adapters and resilient bearing adapter pads between the wheel sets and the side frames at each jaw of the side frames; the improved steering arm assembly, comprising:

(a) a pair of generally U-shaped steering arms, with one of said arms being mounted on the truck on the forward side of said bolster and the other of said arms on the rear side of said bolster, with said steering arms each having a transverse segment with an extremity extending from each end portion of said transverse segment wherein end portions of the extremities are attached to bearing adapter means of the associated wheel set and the transverse segment is positioned along side of the bolster;

(b) a connector post extending from the juncture of each said extremity and said transverse segment to a location spaced from said bolster thereby forming pairs of connector posts in substantially vertical alignment with and spaced from each end portion of said bolster; and (c) linkage means joining each of said pairs of connector posts to maintain said connector posts in a fixed dimension and in a pivotal relation to one another;

said steering arm assembly being operable upon displacement of one of said wheel sets to a radially disposed orientation to displace the other wheel set to a coordinated corresponding position.

2. The steering arm assembly of claim 1, wherein said linkage means includes an omnidirectional bearing means operably connected to said connector post in order to provide vertical and horizontal pivoting of said steering arms relative to one another.

3. The steering arm assembly of claim 2, wherein:

(a) said bearing adapter means each have a bearing adapter mountable over an associated wheel set axle bearing and a resilient adapter pad mounted between the bearing adapter and said side frame; and (b) said bearing adapter is a separate member rigidly secureable to each of said steering arm extremities.

4. The steering arm assembly of claim 2, wherein:

(a) said bearing adapter means each have a bearing adapter mountable over an associated wheel set axle bearing and a resilient adapter pad mounted between the bearing adapter and said side frame; and (b) said steering arm extremities each have one of said bearing adapters formed as an extension thereof.

5. In a radially steerable railway car truck having a transversely extending bolster, a side frame mounted at each end portion of the bolster, and a wheel set mounted transversely between opposed ends of the side frames with bearing adapters and resilient bearing adapter pads between the wheel sets and the side frames at each jaw of the side frames; an improved steering arm assembly, comprising:

(a) a pair of generally U-shaped steering arms with one on the forward and one on the rear side of said bolster, wherein said steering arms each have a transverse segment with an extremity extending from each end portion of said transverse segment with end portions of the extremities attached to a bearing adapter means of the associated wheel set and with the transverse segment positioned along side the bolster;

(b) a connector post extending from the juncture of each said extremity and said transverse segment to a location spaced from said bolster thereby forming pairs of connector posts in substantially vertical alignment with and spaced from each end portion of said bolster; and (c) linkage means joining each of said pairs of connector posts to maintain said connector posts in a fixed dimension and in a pivotal relation to one another;

said steering arm assembly being operable upon displacement of one of said wheel sets to a radially disposed orientation to displace the other wheel set to a coordinated corresponding position.

6. The steering arm assembly of claim 5, wherein said connector posts each have a clevis end portion for operably connecting to said linkage means, said connector posts of each steering arm have one clevis end portion disposed outward of a predetermined location inward of the adjacent side frame and the other clevis end portion disposed inward of the same predetermined location such that mating pairs of said clevis end portions will be positioned to receive said linkage means therebetween for operable cooperative pivoting of said steering arms.

7. The steering arm assembly of claim 6, wherein:

(a) said steering arms are substantially identical in shape and are interchangeable; and (b) said clevis ends each have a pair of spaced apart segments with opening therethrough for inserting a pin member therethrough with the pin longitudinal axis being upright in order to mount said linkage means with said steering arms.

8. The steering arm assembly of claim 7, wherein said linkage means has a rigid link containing an omnidirectionally pivotable bearing means in each end portion thereof, said bearing means has a pivotable member with an aperture therethrough for connection with said pin member.

9. The steering arm assembly of claim 7, wherein:

(a) said bearing adapter means each have a bearing adapter mountable over an associated wheel set axle bearing and a resilient adapter pad mounted between the bearing adapter and said side frame; and (b) said bearing adapter is a separate member rigidly secureable to each of said steering arm extremities.

10. The steering arm assembly of claim 7, wherein:

(a) said bearing adapter means each have a bearing adapter mountable over an associated wheel set axle bearing and a resilient adapter pad mounted between the bearing adapter and said side frame; and (b) said steering arm extremities each have one of said bearing adapters formed as an extension thereof.

11. The steering arm assembly of claim 5, wherein said steering arm transverse segment includes offset end portions connecting the mid-portion thereof to said steeing arm extremities at each side of said steering arms and a center segment connecting the offset end portions and being substantially spaced from said bolster in the longitudinal direction relative to the track.

12. The steering arm assembly of claim 11, wherein said steering arm transverse segment offset end portions in cooperation with their associated extremities forming a generally U-shaped connection between said center segment and said extremities.

13. An improved steering arm assembly for a radially steerable railway car truck having a transversely extending bolster, and a wheel set mounted transversely between opposed ends of the side frames with bearing adapters and resilient bearing adapter pads between the wheel sets and the side frames at each jaw of the side frames; and improved steering arm assembly, comprising:

(a) a pair of generally U-shaped steering arms, with one of said arms being mounted on the forward side of said bolster and the other on the rear side of said bolster, with said steering arms each having a transverse segment with an extremity extending from each end portion of said transverse segment with end portions of the extremitites connectable to bearing adapter means of the associated wheeel set and the transverse segment positioned along side the bolster;

(b) a connector post extending from the juncture of each said extremity and said transverse segment to a location spaced from said bolster thereby forming pairs of connector posts in substantially vertical alignment with and spaced from each end portion of said bolster, said pairs of connector posts being arranged with th end portion of one being outward relative to a center portion of said bolster from the other and in a spaced relation thereto; and (c) linkage means joining each individual pair of connector posts to maintain said connector posts of each pair in a fixed dimension and in a pivotal relation to one another;

said steering arm assembly being operable upon displacement of one of said wheel sets to a radially disposed orientation to displace the other wheel set to a coordinated corresponding position.

14. The steering arm assembly of claim 13, wherein:

(a) said connector posts each have upwardly opening clevis end portions to receive and operably mount said linkage means therebetween; and (b) said steering arms are substantially identical in shape and are interchangeable.

15. The steering arm assembly of claim 13, wherein said linkage means has a rigid link with an omnidirectionally pivotable bearing means at each end portion thereof, said bearing means has a pivotable member mountable between said rigid link and the associated connector post for operably pivotably connecting said link and said steering arms.

* * * * *